US005217363A

United States Patent [19]

Brais et al.

[11] Patent Number: 5,217,363

[45] Date of Patent: Jun. 8, 1993

[54] AIR-COOLED OXYGEN GAS BURNER ASSEMBLY

[75] Inventors: Normand Brais, Rosemére; Jean-Guy Chouinard, Montreal, both of Canada

[73] Assignee: Gaz Metropolitain & Co., Ltd. and Partnership, Montreal, Canada

[21] Appl. No.: 892,992

[22] Filed: Jun. 3, 1992

[51] Int. Cl.[5] ..... F23C 15/06

[52] U.S. Cl. ..... 431/186; 431/187; 431/189; 431/266; 239/401

[58] Field of Search ..... 431/186–189, 431/266, 264; 239/401

[56] References Cited

U.S. PATENT DOCUMENTS

| | | | |
|---|---|---|---|
| 61,632 | 1/1867 | Moody . | |
| 418,582 | 12/1889 | Monsanto . | |
| 859,926 | 7/1907 | Dieckmann et al. . | |
| 935,684 | 10/1909 | Peterson et al. . | |
| 1,028,166 | 6/1912 | Whitford . | |
| 1,241,069 | 9/1917 | Whittaker . | |
| 1,311,815 | 7/1919 | Harris . | |
| 2,207,655 | 6/1936 | Cain . | |
| 2,327,482 | 4/1939 | Aitchison . | |
| 2,327,508 | 1/1942 | Craig . | |
| 3,015,449 | 1/1961 | Meyer . | |
| 3,076,607 | 11/1961 | Cordier . | |
| 3,093,314 | 11/1963 | Meyer . | |
| 3,202,201 | 8/1965 | Masella et al. . | |
| 4,447,010 | 5/1984 | Maeda et al. | 239/401 |
| 4,726,760 | 2/1988 | Skoog | 431/187 |
| 4,976,607 | 12/1990 | Grimard | 431/187 |

OTHER PUBLICATIONS

Oxy-Gas Combustion System Developed for High Temperature Applications by Robert E. Levinson, American Combustion, Inc. Norcross, Ga. 30071, 3 pages (reprinted from Ind. Heating, Nov. 1986).

*Primary Examiner*—Carroll B. Dority
*Attorney, Agent, or Firm*—Longacre & White

[57] ABSTRACT

An air-cooled oxygen-gas burner for use with a direct fired furnace. The burner comprises a body formed from three concentric metal tubes supported in a cylindrical housing secured about a conical bore in a refractory side wall of a furnace. The three concentric tubes have a cone shaped inner end which are adjustable to define a nozzle with annular openings therebetween of variable size to vary the shape of a flame produced by a mixture of combustible gas, oxygen and air fed under pressure, respectively, in each of two chambers defined between the three concentric metal tubes and a chamber defined between the tubes and the cylinder housing. The combustible gas is fed in the inner chamber, the oxygen in the intermediate chamber, while the air is fed in the outer chamber to cool the concentric tube assembly and the furnace refractory about the burner nozzle. The tube assembly can be retracted within the cylinder housing so that the nozzle is protected from the high heat within the furnace after the burner is shut off.

15 Claims, 6 Drawing Sheets

.22
.2
.18
.16
.14
.12
.1
.08
.06
.04
.02
0
-.02
-.04
-.1
0
.1
2.977E+03
2.754E+03
2.531E+03
2.308E+03
2.085E+03
1.862E+03
1.415E+03
1.192E+03
9.692E+02
7.462E+02
5.231E+02
3.000E+02

.22
.2
.18
.16
.14
.12
.1
.08
.06
.04
.02
0
-.02
-.04
-.1
0
.1
3.035E+03
2.807E+03
2.579E+03
2.351E+03
2.123E+03
1.895E+03
1.440E+03
1.212E+03
9.837E+02
7.558E+02
5.279E+02
3.000E+02

AIR-COOLED OXYGEN GAS BURNER ASSEMBLY

BACKGROUND OF THE INVENTION

1. Field of Invention

The present invention relates to an air-cooled oxygen-gas burner for use with a direct fired furnace, and wherein the injection nozzle assembly of the burner has concentric openings which are adjustable to vary the velocity of the gas, oxygen and air injected within the furnace to vary the shape of a flame, and further, wherein the pressure of the gas, oxygen and air is variable to modify the temperature, radiation/convection of the flame.

In particular, the oxygen-gas burner of the present invention was conceived for use in aluminum melting direct fired furnaces, which requires a flame of very high temperature to cause the aluminum to melt quickly so as to reduce the oxidation time in the furnace. As is also known in the art, the flame must also be controllable to produce a high velocity turbulent flame in the initial combustion cycle when the furnace environment and the scrap metal are cold, and to vary the flame characteristic at appropriate times during the melting cycle. For this purpose, variable gas/oxygen/air combustion systems have been developed, and one such system presently used is identified as the "PYRETRON" system (Registered Trademark of American Combustion Inc.) The oxygen is used in the mixture in order to accelerate the oxidation of the fuel inside the hot flame core. The adjustability of the oxygen/air mixture can provide a reduction of the inert nitrogen contained in the air required for complete combustion and the ability to increase the ratio of radiative to convective heat transfer by providing higher flame temperature and lower turbulence due to the reduced overall mass flow. Thus, the flame can be controlled to modify its radiative and convective heat transfer. In the Pyretron system the combustion parameters are controlled in response to changes in the kinetics of the combustion process by controlling the introduction of two distinct oxidizers having different oxygen content, and this can be controlled by programmable logic controllers which monitor the combustion process. This technology is perhaps the most recent development in the art, although other oxygen-gas burners have been developed to achieve the results of reduced energy consumption by 20% in kWh/ton, minimized oxydation and increased production by the shortened melting time of about 40% and of the scrap metal resulting in a production increase of about 20%.

2. Description of the Prior Art

There are, however, some disadvantages of these burner systems, and these can be summarized briefly as follows. One major disadvantage is that, because of the high temperature flame produced by the burner assembly, it is necessary to cool the burner body, and this is achieved by circulating water in a closed system about the body. Great care is therefore required to assure that the risk of water leakage is minimized as, if there were to be leakage of water into the furnace, the contact of water with molten aluminum could cause an explosion. Accordingly, this poses great danger. A still further disadvantage is that the high flame temperature causes rapid degradation of the refractory wall of the furnace, particularly in the environment of the burner nozzle, and accordingly the furnace requires more frequent repair which means that the productivity is affected due to the shut-down time of the furnace required to effect such repair. A still further disadvantage is that the burner nozzle has a very short life as it also deteriorates under the influence of the high temperature flame and the burner must be changed more frequently, thus adding to the cost of the operation.

SUMMARY OF INVENTION

It is therefor a feature of the present invention to provide an air-cooled oxygen-gas burner for use with a direct fired furnace and which substantially overcomes the above-mentioned disadvantages of the prior art.

Another feature of the present invention is to provide an air-cooled oxygen-gas burner which is cooled by air and therefore eliminates the risk of a furnace explosion due to the contact of water with molten aluminum.

A still further feature of the present invention is to provide an air-cooled oxygen-gas burner which produces a flame envelope produced by concentric annular gas ports wherein the center port feeds a combustible gas with oxygen thereabout, and the outer port provides air which envelopes the hot gases for both cooling the nozzle and the adjacent refractory wall, thus subjecting the furnace wall with temperatures compatible with refractory product specification.

Another feature of the present invention is to provide an air-cooled oxygen-gas burner for use with a direct fired furnace for the melting of scrap pieces of aluminum and steel, and which is also capable of producing a stable controlled flame over the entire melting cycle of the furnace.

Another feature of the present invention is to provide an air-cooled oxygen-gas burner injection nozzle, and wherein the concentric annular gas ports are adjustable to vary independently the injection velocity of the gas, the oxygen and the air. This provides flame length and diameter variation capability even at constant heat input.

Another feature of the present invention is to provide an air-cooled oxygen-gas burner wherein the entire burner can be retracted during operation to displace the injection nozzle out of the refractory furnace environment to protect it from the high heat within the furnace.

Another feature of the present invention is to provide an air-cooled oxygen-gas burner wherein the injection nozzles are removably secured to the inner end of the burner for replacement, and wherein the electrode for ignition is also easily removable from the burner assembly.

Another feature of the present invention is to provide controllable pressure regulating means for the combustion gas, oxygen and air which are independently controllable, and wherein their gas ports in the injection nozzle are also independently controllable, and wherein such control can be effected by automatic control circuit means.

According to the above features, from a broad aspect, the present invention provides an air-cooled oxygen-gas burner for use in a direct fired furnace. The burner comprises a burner body formed by three concentrically disposed metal tubes supported in spaced relationship to define first and second chambers therebetween. An injection nozzle is provided at an inner end of the metal tubes and defines a first and second adjustable annular port therebetween. A third adjustable annular port is defined between an outer one of the metal tubes and a bore of predetermined shape formed in a refractory wall of a furnace. A cylindrical housing is secured about the bore outside the refractory wall with the body being supported in spaced concentric position within the cylindrical housing to form a third chamber therebetween. A spark plug is disposed at a free end of the injection nozzle. Adjustable means is also provided to feed, under pressure, a combustible gas and oxygen in the first and second chambers respectively. Further adjustable means is provided to feed air under pressure in the third chamber. Means is provided to axially displace the three metal tubes independently from one another to vary the size of the adjustable annular ports between the cone-shaped end sections to thereby vary the shape of a flame produced at the nozzle free end by combustion of a mixture of the combustible gas, oxygen and air. The adjustable means controls the injection velocities to vary the intensity of the flame.

BRIEF DESCRIPTION OF THE DRAWINGS

A preferred embodiment of the present invention will now be described with reference to the accompanying drawings, in which.

Figure 1:
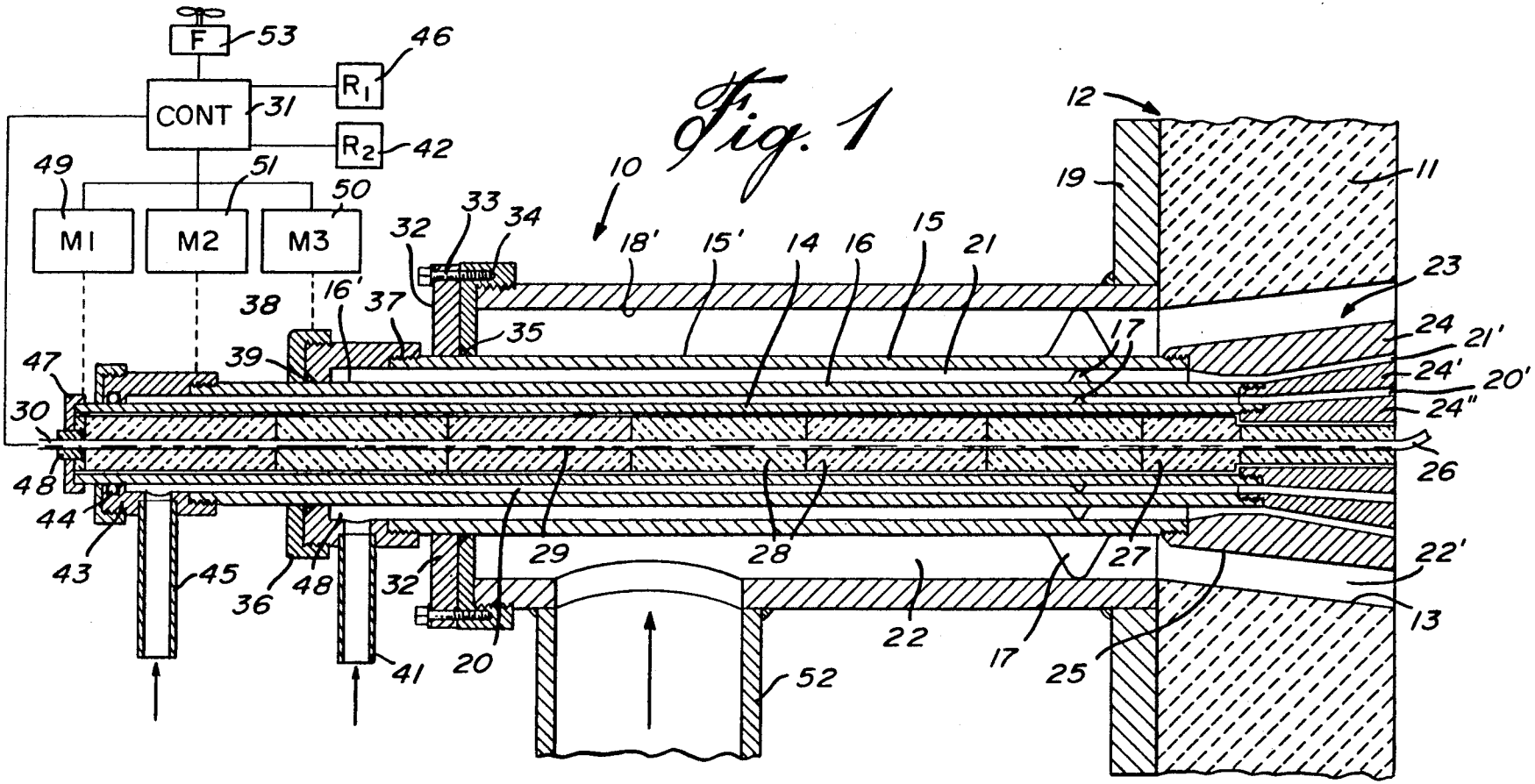
FIG. 1 is a sectional view illustrating the construction of the oxygen-gas burner of the present invention secured to a direct fired furnace refractory wall.

DESCRIPTION OF PREFERRED EMBODIMENTS:

Referring to the drawings, and more particularly to FIGS. 1 to 4, there is shown generally at 10 the air-cooled oxygen-gas burner of the present invention connected to a furnace 12 about a conical bore 13 which is formed in the refractory wall 11 of the furnace. The oxygen-gas burner 10 is comprised of a burner body formed by three concentrically disposed stainless steel metal tubes, herein inner tube 14, outer tube 15, and intermediate tube 16 supported in spaced concentric relationship by metal spacers 17 secured to an outer wall of each of the tubes. The spacers can be steel wire spacers or pins, and these can be distributed at different locations between the tubes. These three metal tubes are also supported in spaced concentric positon within a cylindrical housing 18 which is secured to the furnace outisde wall by flange 19 and disposed about the conical bore 13 of the furnace 12.

As shown, the concentrically disposed and spaced apart tubes 14, 15 and 16 and the cylinder 18 define therebetween chambers in which a combustible gas, oxygen and air are fed, respectively. The area between the inner tube 14 and the intermediate tube 16 defines an inner combustible gas chamber 20. The area between the outer tube 15 and the intermediate tube 16 defines an oxygen chamber 21, while the area between the outer tube 15 and the cylindrical housing 18 defines an air chamber 22.

An injection nozzle 23 is defined at an inner end of the metal tubes and is formed by, removably connected, concentrically spaced, metal cone sections 24, 24' and 24'' secured respectively to the outer tube 15, the intermediate tube 16 and the inner tube 14. Accordingly, the injection nozzle 23 is of cone shape with their nozzle envelop disposed at a specific diverging angle. The metal cone sections are also displaceable axially to define therebetween variable annular gas ports 21' and 20'. A further annular port 22' is formed between the outer wall 25 of the outer metal cone section 24 and the face of the conical bore 13. A spark plug 26 is disposed within the inner tube 14 and insulated therefrom by an electrically insulating cylinder 27 which is composed of a plurality of porcelain cylinders 28 disposed all along the inner tube 14. Spark plug 26 is formed at the free end of an elongated electrode rod 29 extending through the insulating cylinder 27 and connected to a voltage supply at the outer end 30 thereof. This spark plug 26 is controlled by control circuit 31 which is utilized to fire the burner 10 and which also controls the entire operation of the burner assembly and pressurized gas, as will be described later.

The cylindrical housing 18 is secured about the conical bore 13 in axial alignment therewith. The cylindrical housing has an end wall 32 connected by fasteners 33 to a threaded bushing 34 which is in threaded engagement with the rear end of the cylindrical housing 18. An O-ring seal 35 is retained captive by the bushing 34 against the outer wall 15' of the outer tube 15 to provide a seal therebetween.

Figure 2:
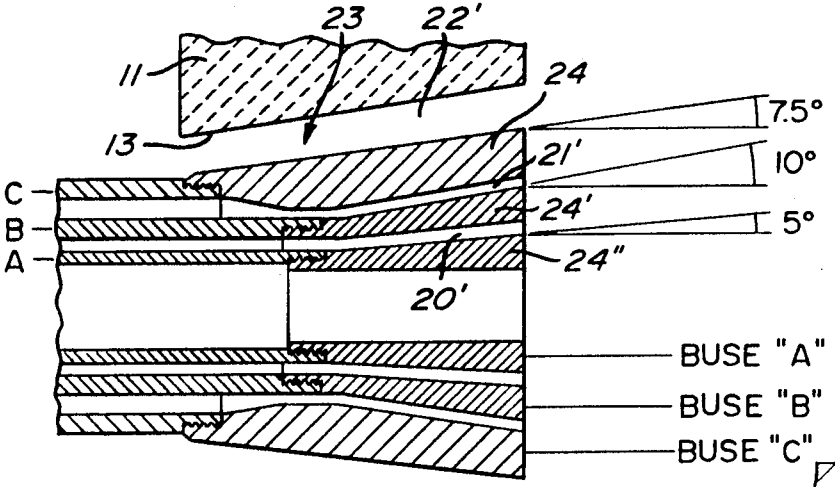
FIG. 2 is a section view of the burner nozzle with its annular gas ports and air port fully open.
Figure 3:
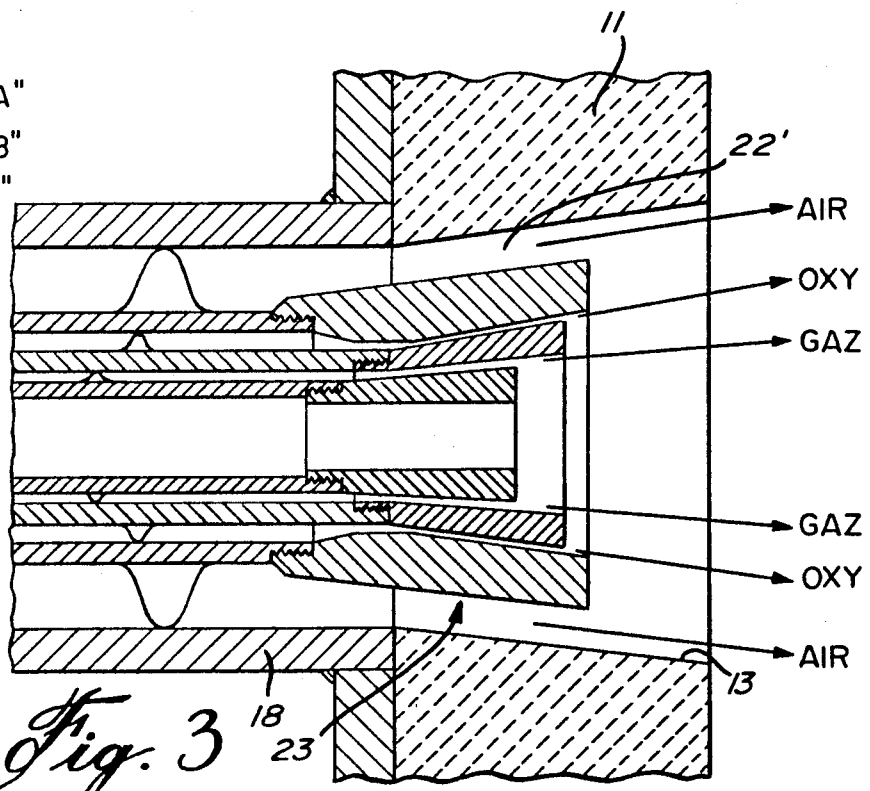
FIG. 3 is a view similar to FIG. 2, but showing the burner nozzle slightly retracted, and its gas and air ports in their minimal open positons.
Figure 4:
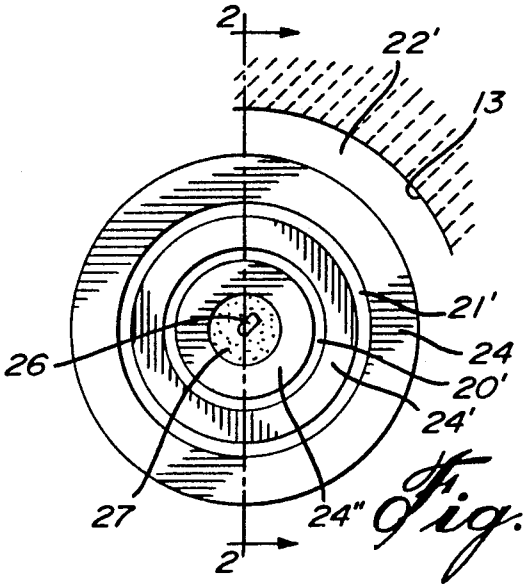
FIG. 4 is an end view of the burner injection nozzle showing the arrangement of the concentric ports.
Figure 5:
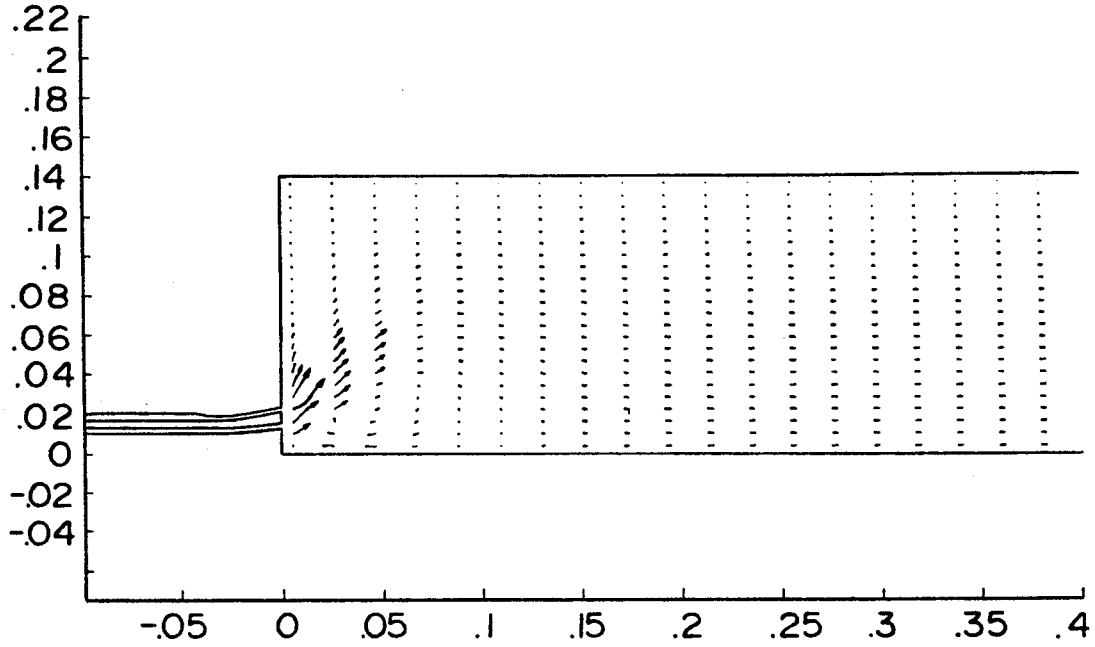
FIG. 5 is a numerical simulation showing the velocity vector field which illustrates the distribution of the gas and thus the shape of the flame at low pressure.
Figure 6:
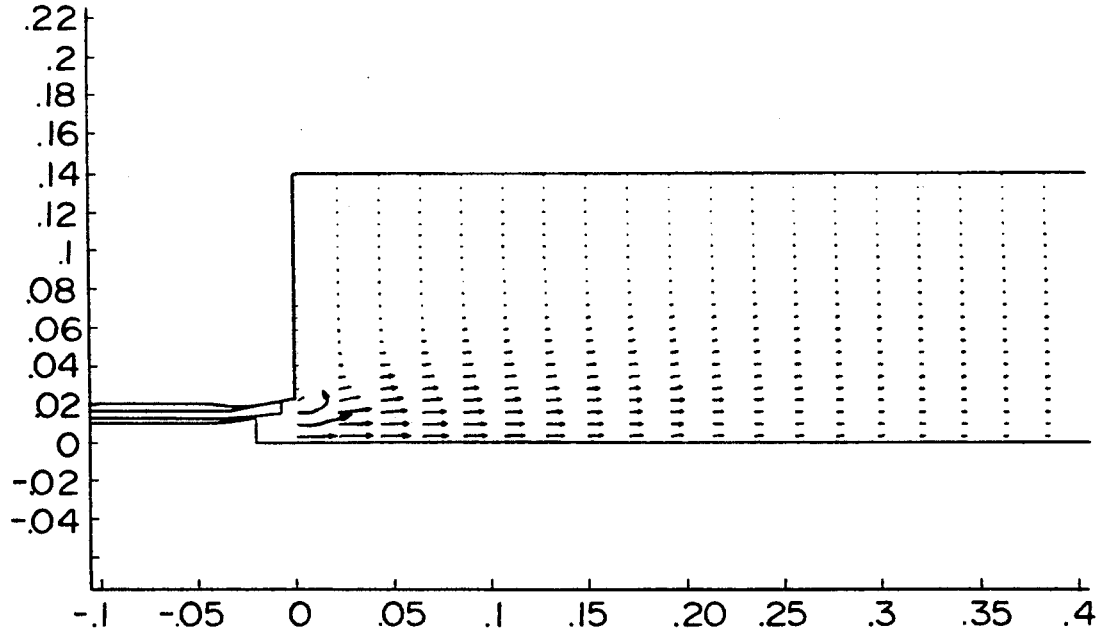
FIG. 6 is a numerical simulation diagram, similar to FIG. 5, but showing the results at high pressure.

As previously described, the annular gas ports 20' and 21' and the air port 22' are adjustable to vary the shape of the flame, and the oxygen/air ratio is adjusted to modify the temperature, radiation and convection. As shown in FIG. 2, all of the metal cone sections 24, 24' and 24'' are in alignment in their full advanced position and aligned forward within the conical bore 13 of the refractory wall 11, to provide maximum port openings. In order to vary the shape of the flame the three tubes 14, 15 and 16 are displaced axially to displace their respective metal cone sections thereby varying the size of the annular gas ports and air port. Such a variation is illustrated in FIG. 3 where all three cone sections are displaced from one another. The shape of the flame is thus controlled during the melting process of scrap aluminum metal placed in the furnace, and as determined by various requirements of the furnace. As also shown in FIG. 3, the injection nozzle 23 is also retractable inwards and fully within the cylindrical housing 18 to protect the nozzle 23 from the heat within the furnace after the burner is shut off. Of course, various burners may be provided in the refractory wall 11 of the furnace and directed at specific angles depending on the design of the furnace. By protecting the nozzle the longevity of the burner is extended. It is also pointed out that the air port 22' provides cooling air about the burner nozzle and shields the refractory wall from the hot flame in the immediate region of the conical bore 13. Not only is this air used in the combustion mixture, but it also serves the additional cooling purpose which prolongs the life of the burner head and the refractory wall as well as permitting the flame to be at a higher temperature than the refractory material specification.

It is also pointed out that by providing annular gas ports and controlling the size of their opening, not only can the flame shape be modified, but there results a better mixture and faster combustion of the gas to produce this very hot flame. The combustion gas utilized herein is natural gas, although other combustible gases may be used. The oxygen is released in an envelope about the combustible gas while the air is also injected in an envelope about the oxygen and combustible gas. By independently controlling the air and oxygen we can control and cut back on the oxygen use to reduce the oxidation of the molten metal.

The manner in which the tubes are coupled together and displaced will now be described. As shown in FIG. 1, an annular coupling 36 is secured to an outer end of the outer tube 15 by a threaded connection 37. This coupling has a threaded cup 38 threadedly secured to an end thereof and retaining an O-ring seal 39 therein in sealing engagement with the outer wall 16' of the intermediate tube 16. The coupling 36 forms a chamber 40 therein which is coupled to the oxygen chamber 21. An oxygen inlet coupling 41 is secured to the annular coupling 36 and to a pressure regulator 42 which is connected to an oxygen supply, such as a pressurized gas tank to feed oxygen to the inlet coupling 41 and into the oxygen chamber 21. The regulator is monitored and controlled by the control circuit 31 to feed oxygen under pressure between 0 to 50 psig for the application of the burner of the present invention.

An annular end coupling 43 is also secured to an outer end of the intermediate tube 14 in a similar manner as the coupling 36, and is in sealing relationship with the outer wall thereof by the provision of the O-ring seal 44. It also has a gas inlet coupling 45 connected thereto whereby a combustible gas, such as natural gas, is fed thereto through a regulating valve 46 also controlled by the control circuit 31 in order to feed the combustible gas under pressure between 0 to 10 psig. This regulator is a pressure reducing regulator to reduce the natural gas pressure commonly found in the supply lines which is usually in the range of 15 to 60 psig.

The inner tube is closed by a bushing 47 having an insulating washer 48 through which the end of the electrode rod 29 projects for connection to an electrical supply.

Each of the tubes 14, 15 and 16 is independently controlled by motors 49, 50 and 51 connected thereto by suitable connection means, not shown, but well known to a person skilled in the art, and these motors are in turn controlled by the control circuit 31 to displace the tubes axially. The control circuit 31 may be a computer control circuit, or can be controlled by the existing control equipment of the furnace. This circuit controls the entire operation of the melting cycle by varying the flame configuration as well as the gas, oxygen, and air pressures.

It can be seen that the cylindrical housing 18 is also provided with an air inlet coupling 52 connected adjacent the end wall 32 thereof for feeding air in the third air chamber 22, about the outer tube 15 for cooling the burner assembly. The air is fed under pressure by a fan 53 which is also controlled by the control circuit 31. The fan 53 is an adjustable speed fan capable of providing the air pressure between 0 to 2 psig.

As previously described, the shape of the flame is varied by changing the dimensions of the gas ports of the injection nozzles and the position of the nozzle within the conical bore, whereas the temperature, radiation/convection of the flame is adjusted by adjusting the respective pressures of the combustion gas, oxygen and air. The outer concentric air circuit about the burner injection nozzle greatly increases the life of the burner and the refractory wall of the furnace and optimize the economy of the system. These results of the burner have been verified by numerical simulation. It has been established that the flame temperature of the burner can be in the order of 2900° C. (5200° F.) when the burner functions with 100% oxygen. Although known refractory furnace materials cannot resist these high temperatures, it is possible with the present invention to maintain a high flame temperature while cooling the refractory and the burners.

With further reference to FIGS. 5 to 12, there is shown two sets of numerical simulation characteristics of the flame of this burner. The first set is obtained with the injection nozzle annular gas ports fully open at low oxygen-gas pressures, wherein the combustible natural gas pressure was 0.012 psig and the oxygen pressure 0.2 psig developing a 100 kW power or 340,000 BTU/hr. The second simulation is with the oxygen-gas at a high pressure with the nozzle cone sections retracted, as shown in FIG. 3, and the annular gas ports at their minimum opening, and wherein the combustion gas pressure was at 0.5 psig with the oxygen pressure at 3.5 psig, and also developing 100 kW power (340,000 BTU/hr).

Figure 7:
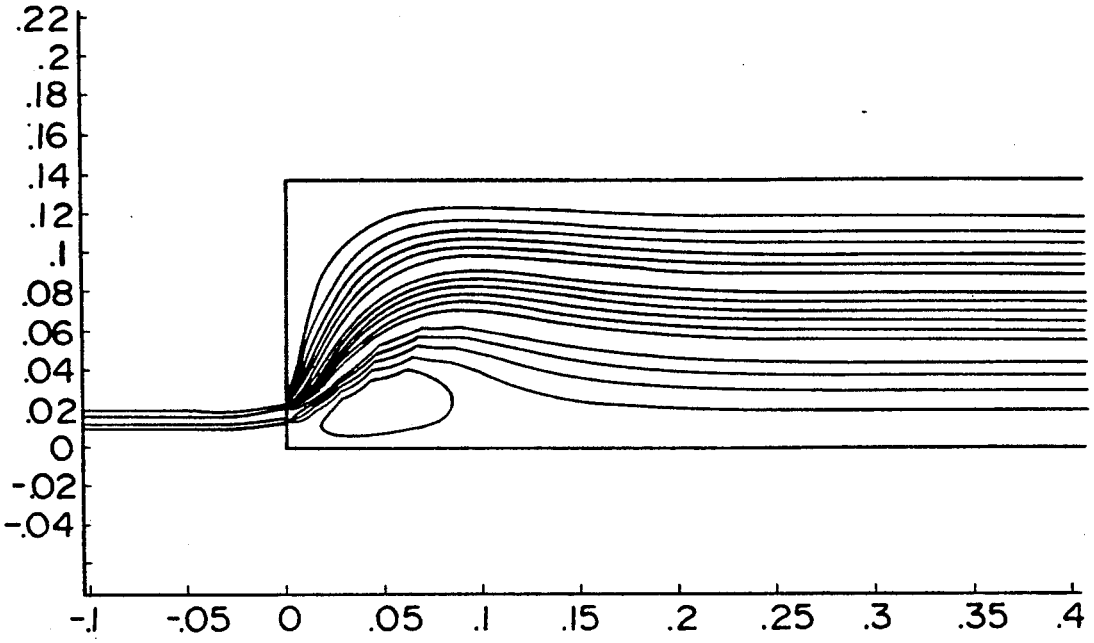
FIG. 7 is a numerical simulation diagram which shows the streamlines at low pressure.

FIGS. 5 to 8 illustrate clearly the fundamental differences existing between the flame configuration and the speed of the combustion gases. As shown in FIG. 7, at low pressure the recirculation of the combustible products is internal to the flame 61, as shown by the region denoted by reference numeral 60, whereas in the case of a high pressure feed the recirculation of the combustible products is external to the flame 61 as denoted by reference numeral 62 in FIG. 8. As shown by these figures, the shape of the flame can therefore be varied from a soft ball-shaped flame at low pressure, FIGS. 5 and 7, to a hard elongated flame, FIGS. 6 and 8, when utilizing high pressures.

Figure 9:
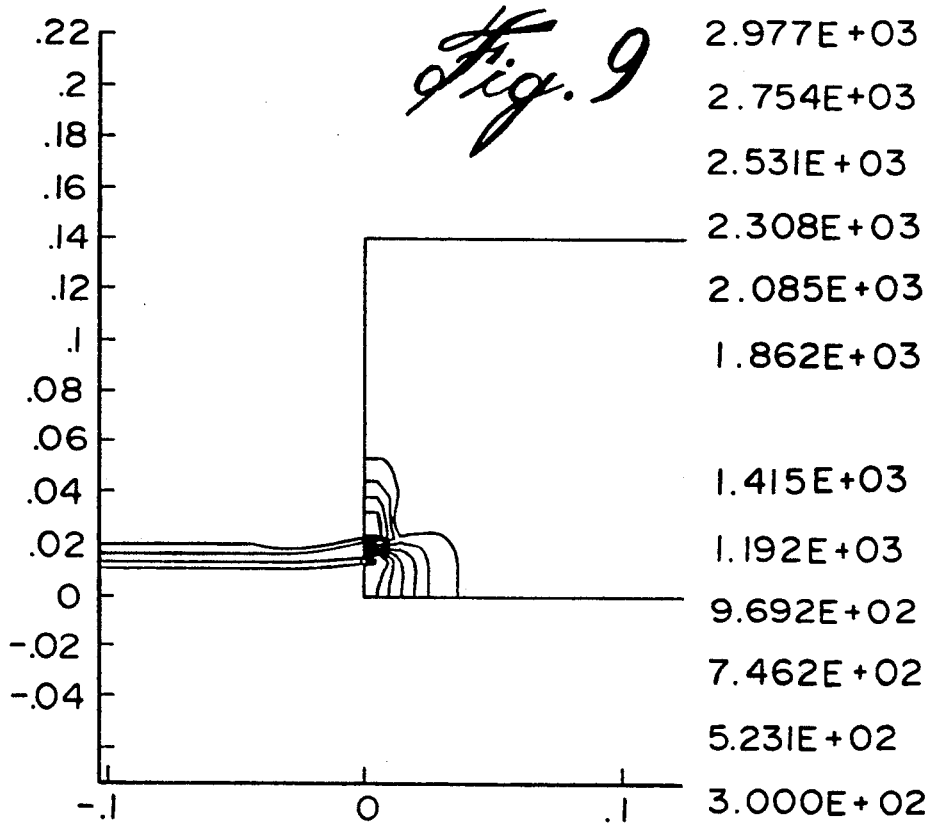
FIG. 9 is a numerical simulation diagram illustrating the distribution of the temperature of the flame at low pressure.
Figure 10:
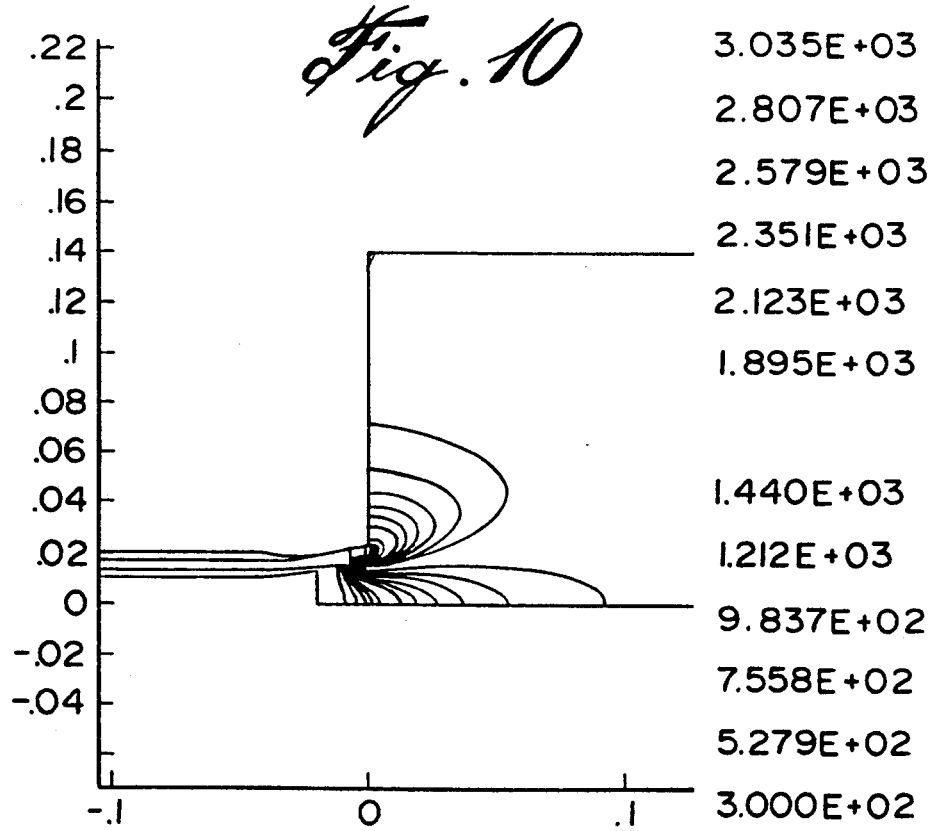
FIG. 10 is a view similar to FIG. 9, but illustrating the temperature distribution at high pressure.

With reference now to FIGS. 9 and 10 it can be seen that the distribution of temperatures within the flame and its environment indicates that the maximum temperature achieved at low pressure is 3200° K. (2927° C.), whereas at high pressures the maximum temperature achieved was 3263° K. (2990° C.). We can also observe from these characteristics that the temperature on the refractory wall is in both cases in the order of 2000° C. to 2500° C., a level of temperature which is much too high for refractory materials which are presently available on the market. Accordingly, it can be shown that by the present invention by controlling the shape of the flame and adding air in a circuit about the burner nozzle, it is possible to cool the flame envelop in the area of the refractory wall about the conical bore to a temperature that is compatible with currently available refractory materials while still obtaining a high temperature flame core which has an improved homogeneous temperature within the oven which is particularly appropriate for the fusion of metals.

Figure 11:
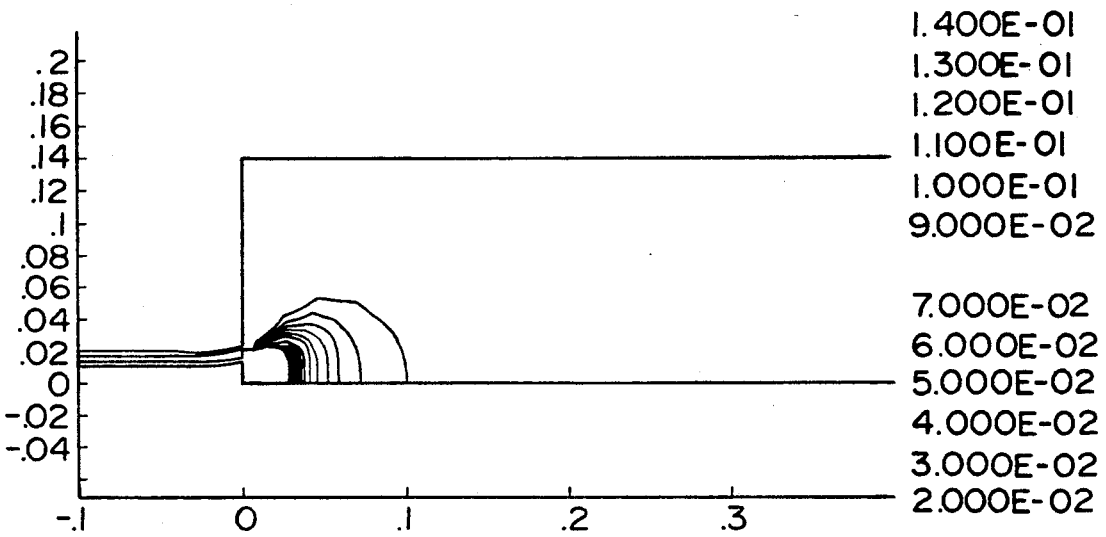
FIG. 11 is a numerical simulation diagram illustrating the iso-concentration of gas of the burner at low pressure.
Figure 12:
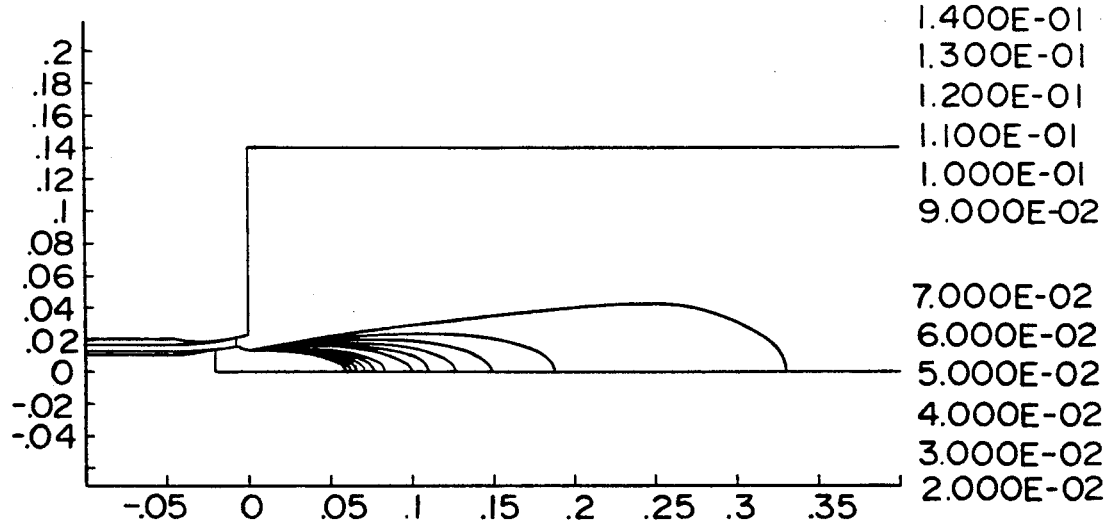
FIG. 12 is a view similar to FIG. 11 but illustrating the iso-concentration of gas of the burner at high pressure.

With reference now to FIGS. 11 and 12, we can now observe the shape of the flames that can be obtained by iso-concentrations of the combustible gases. Both axis of this diagram are graduated in meters. The characteristic indicates a concentration in combustion gases of 2% which corresponds approximately to the boundary of the flame. By estimating the volume of the flame for each case, we obtain an average volumetric heat release of 190 $MW/m^3$ for a low pressure flame as illustrated in FIG. 11, and an average volumetric heat release of 320 $MW/m^3$ for a high pressure flame, as shown in FIG. 12. The burner of the present invention provides for the variation of the combustion intensity as needed by adjusting the size of the annular gas injection ports.

Figure 8:
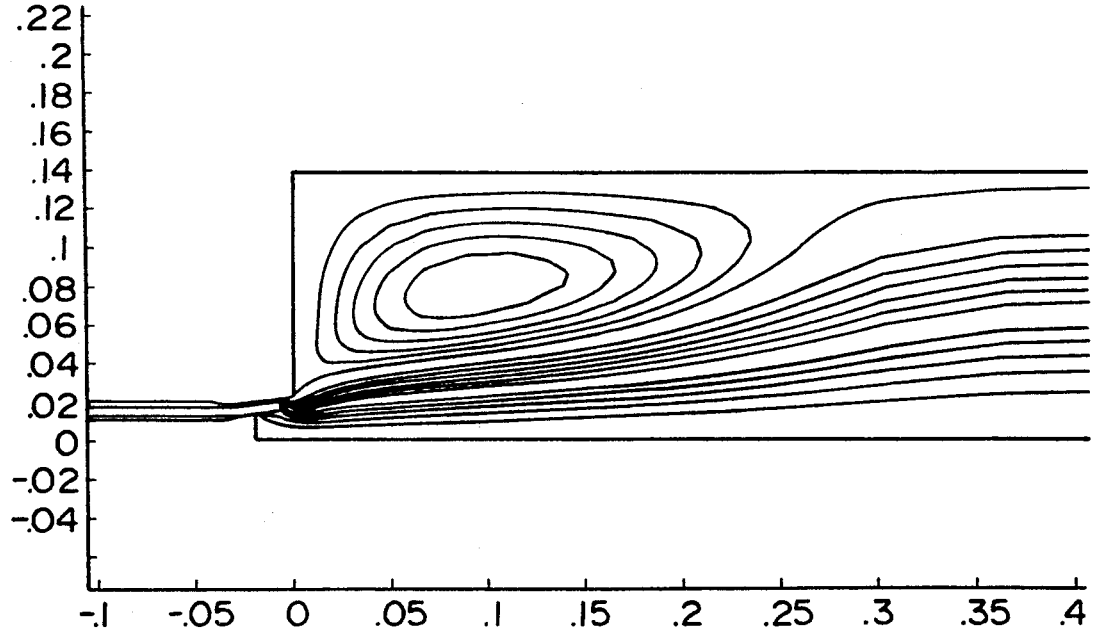
FIG. 8 is a view similar to FIG. 7 showing the streamlines at high pressure.

We can therefore conclude from the analysis of this numerical simulation that, as illustrated in FIG. 8, by utilizing a flame at high pressure there is provided a good turbulence in the flue gases within the furnace thus achieving improved heat transfer by convection. By utilizing air in the combustion it also results in an increase of the convective heat transfer from increased mass flow.

It is within the ambit of the present invention to cover any obvious modifications of the preferred embodiment described herein, provided such modifications fall within the scope of the appended claims.

We claim:

1. An air-cooled oxygen-gas burner for use with a direct fired furnace, said burner comprising a burner body formed by three concentrically disposed metal tubes supported in spaced relationship to define first and second chambers therebetween, an injection nozzle at an inner end of said metal tubes including frusto-conical shaped end sections and defining a first and second adjustable annular port therebetween, a third adjustable annular port defined between an outer one of said metal tubes and a frusto-conical bore of predetermined shape formed in a refractory wall of a furnace, a cylindrical housing for securement about said bore outside said refractory wall, said burner body being supported in spaced concentric position within said cylindrical housing to form a third chamber therebetween, a spark plug disposed at a free end of said injection nozzle, adjustable means to feed under pressure a combustible gas and oxygen in said first and second chambers respectively, further adjustable means to feed air under pressure in said third chamber, and means to axially displace said three metal tubes independently from one another to vary the size of said adjustable annular ports between said frusto-conical shaped end sections to thereby vary the shape of a flame produced at said nozzle free end by combustion of a mixture of said combustible gas, oxygen and air, said adjustable means controlling the injection velocities to thereby vary the intensity of said flame.

2. An air-cooled oxygen-gas burner as claimed in claim 1 wherein said frusto conical inner end sections are removably connected metal sections secured to a respective inner end of one of said three metal tubes.

3. An air-cooled oxygen-gas burner as claimed in claim 1 wherein said cylindrical housing is an elongated cylinder housing secured in axial alignment with said frusto-conical shaped bore, said bore having its larger diameter end at an inner surface of said refractory wall, said cylinder housing having an end wall with a circular bore through which said three concentric metal tubes project in sealing displaceable relationship with said outer one of said tubes.

4. An air-cooled oxygen-gas burner as claimed in claim 3 wherein an air inlet coupling is connected to said cylinder housing adjacent said end wall for feeding air in said third chamber about said outer one of said tubes and out of said burner through said third adjustable annular opening, said air cooling said outer tube and mixing with said oxygen and gas at said nozzle free end.

5. An air-cooled oxygen-gas burner as claimed in claim 4 wherein said further adjustable means to feed air under pressure is an adjustable flow fan to vary said air pressure between 0 to 2 psig.

6. An air-cooled oxygen-gas burner as claimed in claim 3 wherein an annular coupling is secured to an outer end of said outer one of said tubes and in sealing relationship over an intermediate one of said tubes, an oxygen inlet coupling connected to said annular coupling and communicating with said second chamber to feed oxygen under pressure therein.

7. An air-cooled oxygen-gas burner as claimed in claim 6 wherein said adjustable means to feed said oxygen is a pressure regulator connected between said oxygen inlet coupling and a pressurized supply of oxygen, said regulator controlling said oxygen pressure between 0 to 50 psig.

8. An air-cooled oxygen-gas burner as claimed in claim 3 wherein an annular end coupling is secured to an outer end of said intermediate tube and in sealing relationship over an inner one of said three tubes, a combustible gas inlet coupling connected to said annular end coupling and communicating with said first chamber to feed combustible gas under pressure therein.

9. An air-cooled oxygen-gas burner as claimed in claim 8 wherein said adjustable means to feed said combustible gas is a pressure regulator connected between said combustible gas inlet coupling and a pressurized supply of combustible gas, said regulator controlling said combustible gas pressure between 0 to 10 psig.

10. An air-cooled oxygen-gas burner as claimed in claim 1 wherein an inner one of said three metal tubes is provided with an electrically insulating cylinder therein and extending end to end thereof, an elongated electrode rod disposed in said insulating cylinder, said spark plug being formed at an inner end of said electrode rod, said rod being removable from said insulating cylinder from said spark plug end.

11. An air-cooled oxygen-gas burner as claimed in claim 1 wherein said means to axially displace said three metal tubes are motor controlled displaceable means, a control circuit to automatically control the relative position of said tubes dependent on required flame shape geometry, said control circuit also controlling a pressure regulator associated with said first and second chamber respectively and a fan associated with said third chamber to automatically control the quantity of gas and air to thereby control the temperature and radiation/convection of said flame.

12. An air-cooled oxygen-gas burner as claimed in claim 1 wherein said three metal tubes are stainless steel tubes, said tubes being supported in concentric spaced apart relationship by metal spaces secured to an outer wall of said tubes.

13. An air-cooled oxygen-gas burner as claimed in claim 1 wherein said furnace is an aluminum recovery furnace for melting aluminum scrap metal.

14. An air-cooled oxygen-gas burner as claimed in claim 11 wherein said three metal tubes are automatically retracted within said elongated cylinder housing by said motor controlled displaceable means operated by said control circuit when said flame is shut off to protect said injection nozzle from heat generated in said furnace by a molten metal bath therein.

15. An air-cooled oxygen-gas burner as claimed in claim 1 wherein said combustible gas is natural gas.

* * * * *